US005336133A

United States Patent [19]

Chen

[11] Patent Number: 5,336,133

[45] Date of Patent: Aug. 9, 1994

[54] OSCILLATING MECHANISM FOR A CRYSTAL BALL

[76] Inventor: Joseph Chen, P.O. Box 82-144, Taipei, Taiwan

[21] Appl. No.: 20,992

[22] Filed: Feb. 22, 1993

[51] Int. Cl.[5] ..... A63H 13/20

[52] U.S. Cl. ..... 472/6; 74/49

[58] Field of Search ..... 472/6, 12, 96, 7, 95; 446/236, 484, 489; 74/49, 50; 40/411, 421

[56] References Cited

U.S. PATENT DOCUMENTS

| | | | |
|---|---|---|---|
| 1,323,902 | 12/1919 | Obolewicz | 446/236 |
| 1,389,372 | 8/1921 | Mitera | 446/236 |
| 3,243,914 | 4/1966 | Poynter | 446/484 X |
| 3,613,305 | 9/1966 | Suzuki | 446/484 X |
| 4,214,749 | 7/1980 | Kulesza | 472/6 X |
| 4,573,939 | 3/1986 | Hoshiro | 472/6 X |
| 4,643,692 | 2/1987 | Magers | 472/6 X |
| 4,910,897 | 3/1990 | Hsu | 472/6 X |
| 4,925,182 | 5/1990 | Hou | 472/6 |
| 4,987,787 | 1/1991 | Hou | 472/12 X |
| 5,070,633 | 12/1991 | Liu | 472/6 X |
| 5,088,218 | 2/1992 | Liu | 446/236 X |
| 5,088,949 | 2/1992 | Atkinson | 446/236 X |
| 5,090,144 | 2/1992 | Liu | 40/411 X |
| 5,134,795 | 8/1992 | Wang | 472/6 X |

*Primary Examiner*—Carl D. Friedman
*Assistant Examiner*—Beth Aubrey
*Attorney, Agent, or Firm*—Alfred Lei

[57] ABSTRACT

This invention relates to an oscillating mechanism for a crystal ball and in particular to one including a spring device, a driving gear connected with the spring means, a driven gear engaged with the driving gear and having an eccentric shaft with a circular stop at the end, and a linking rod provided with two prongs fitted over the eccentric shaft of the driven gear, two arms pivotally mounted on a frame of the crystal ball, and a driving rod connected to a rocking horse, whereby the rocking horse will swing forwards and backwards when the spring device releases its stored energy.

1 Claim, 6 Drawing Sheets

OSCILLATING MECHANISM FOR A CRYSTAL BALL

BACKGROUND OF THE INVENTION

It has been found that that the conventional oscillating mechanism for a crystal ball is complicated in structure thereby making it difficult to manufacture. As illustrated is FIGS. 1, 2 and 3, there is shown a prior art oscillating mechanism for a crystal ball. As may be seen, the oscillating mechanism includes a spring means 6, a gear 7 driven by the spring means 6, a pinion 8 engaged with the gear 7, a disc 81 connected with the pinion 8, an eccentric shaft 82 on the disc 81, a circular member 9 having an elongated slot 91 for receiving the eccentric shaft 82, and a plug 10. When in operation, the spring means 6 will drive the gear 7 to rotate. Then, the gear 7 will turn the pinion 8 which will in turn rotate the disc 1. Meanwhile, the eccentric shaft 82 will rotate with respect to the axis of the disc thereby making the circular member 9 to swing backwards and forwards and therefore, oscillating the rocking hots 11. However, such mechanism is complicated in structure and difficult to assemble.

Therefore, it is an object of the present invention to provide an improved tool box which may obviate and mitigate the above-mentioned drawbacks.

SUMMARY OF THE INVENTION

This invention relates to an improved oscillating mechanism for a crystal ball.

It is the primary object of the present invention to provide an improved oscillating mechanism for a crystal ball which is simple in construction.

It is another object of the present invention to provide an improved oscillating mechanism for a crystal ball which is easy to assemble.

It is still another object of the present invention to provide an improved oscillating mechanism for a crystal ball which is economic to produce.

It is still another object of the present invention to provide an improved oscillating mechanism for a crystal ball which is facile to fabricate.

It is a further object of the present invention to provide an improved oscillating mechanism for a crystal ball which is low cost.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PRESENT INVENTION

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
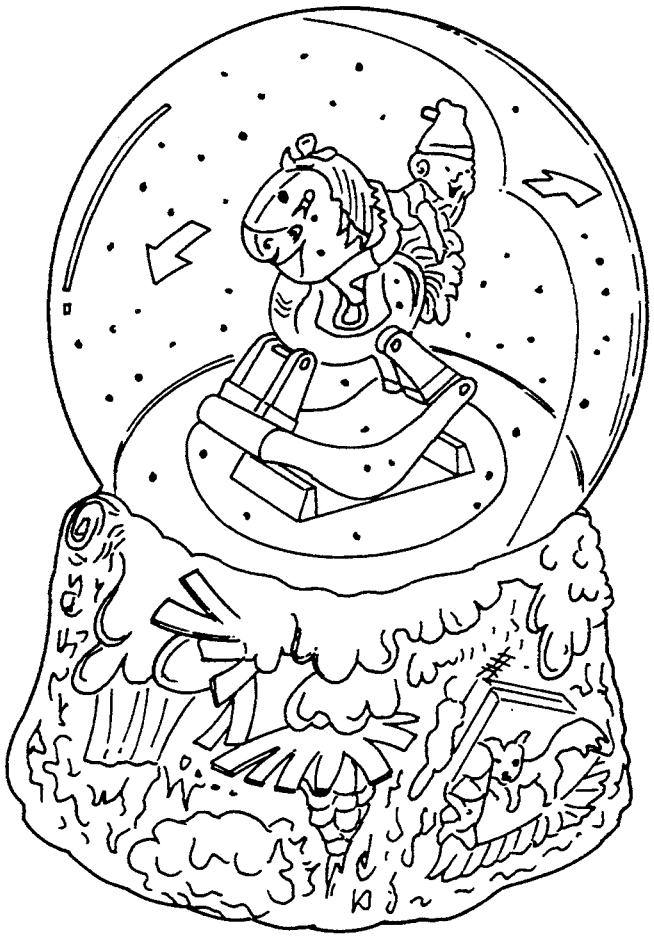
FIG. 1 PRIOR ART
FIG. 1 shows a perspective view of a crystal ball.
Figure 2:
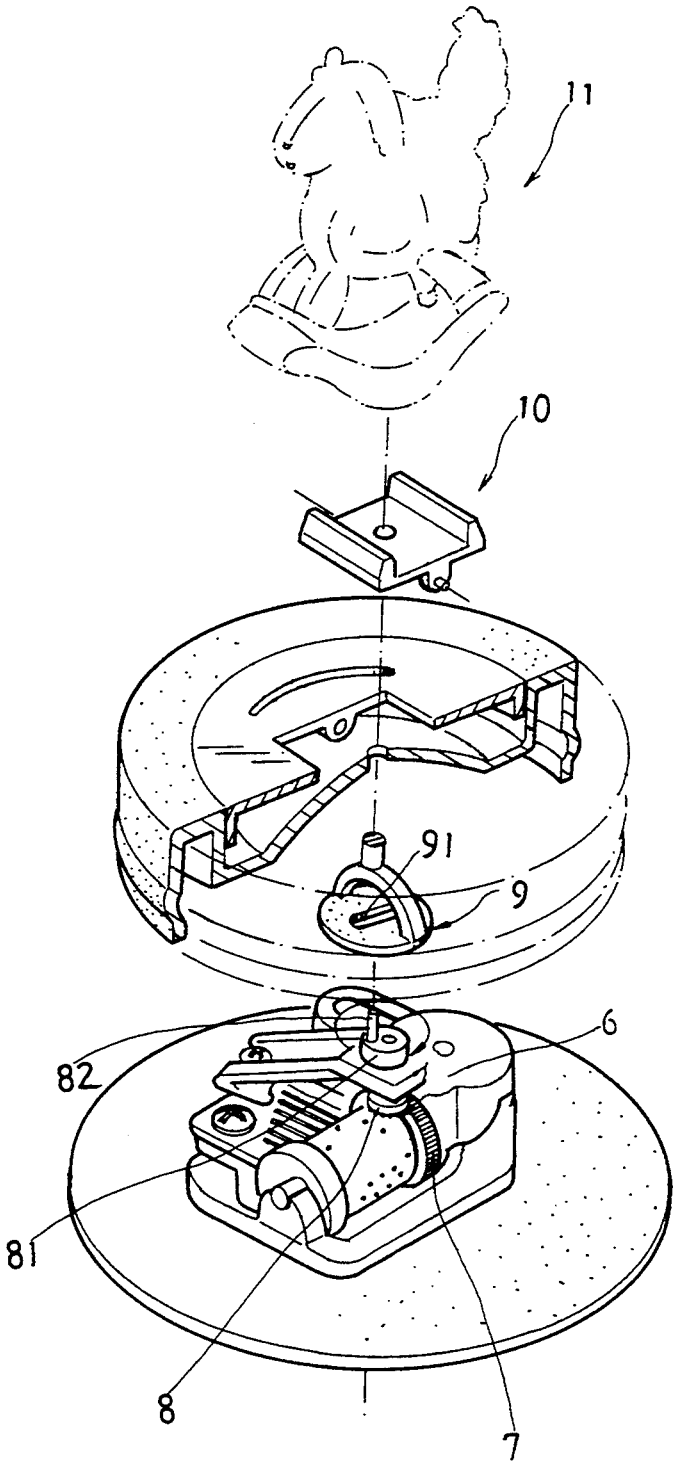
FIG. 2 PRIOR ART
FIG. 2 is an exploded view of a prior art oscillating mechanism for a crystal ball.
Figure 3:
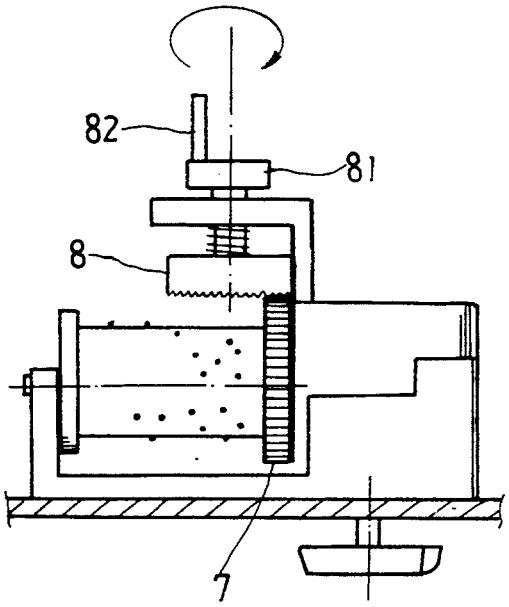
FIG. 3 PRIOR ART
FIG. 3 is a sectional view of the prior art oscillating mechanism for a crystal ball.
Figure 4:
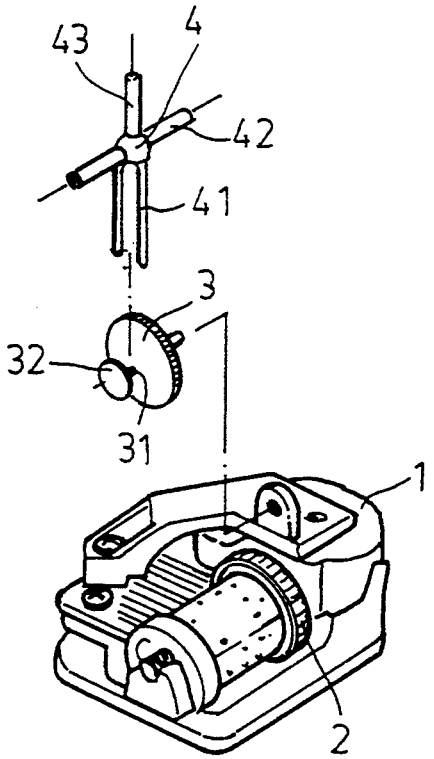
FIG. 4 is an exploded view of an improved oscillating mechanism for a crystal ball according to the present invention.
Figure 5:
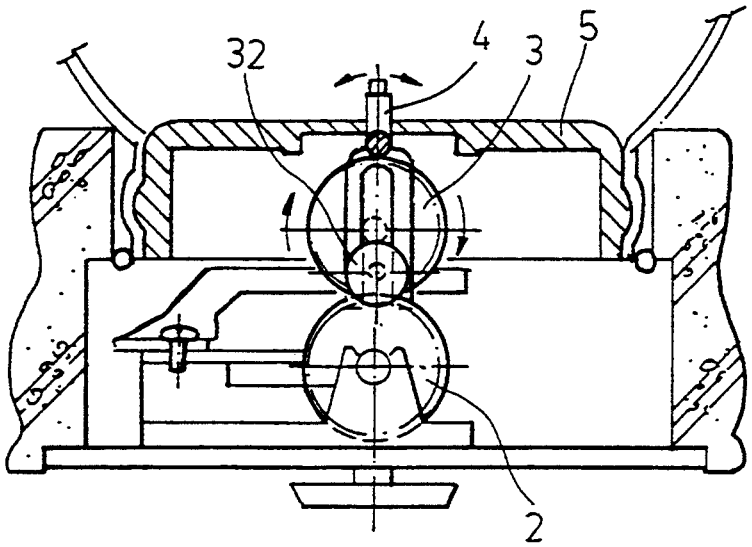
FIG. 5 is a sectional view of the improved oscillating mechanism for a crystal ball.
Figure 6A:
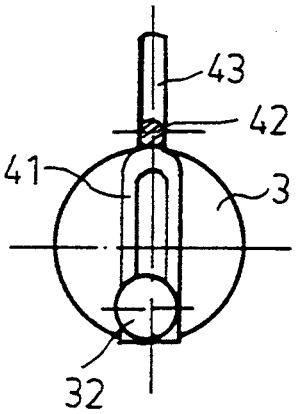
FIGS. 6A, 6B and 6C show the working principle of the improved oscillating mechanism according to the present invention.
Figure 6B:
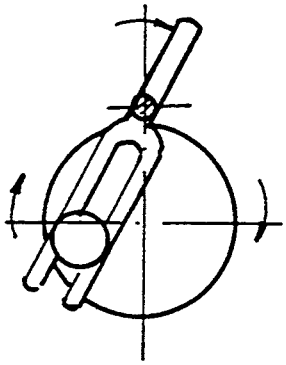
Figure 6C:
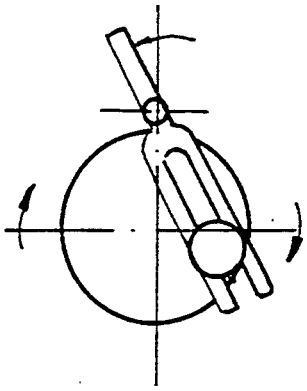

With reference to the drawings and in particular to FIGS. 4 through 6, the oscillating mechanism according to the present invention mainly comprises a spring means 1, a driving gear 2, a driven gear 3, and a linking rod 4 The spring means 1 is well known in the art and has no need to be mentioned here in detail. The spring means 1 is connected with the driving gear 2 and so it will make the driving gear 2 rotate when releasing its stored energy. The driving gear 2 is meshed with the driven gear 3 so that the driven gear 3 will rotate in unison with the driving gear 2. Further, the driven gear 3 is provided with an eccentric shaft 31 having a circular stop 32 at its end. The driven gear 3, the eccentric shaft 31 and the circular stop 32 are preferably formed into one piece by injection molding. The linking rod 4 is a fork-like member having two prongs 41 adapted to fit over the eccentric shaft 31. In addition, the linking rod 4 has two arms 42 which are pivotally mounted on a cover 5 so that the linking rod may rotate with respect to the axis along the two arms 42. Further, the linking rod 4 is formed on the top with a driving rod 43 which is to be connected with a rocking horse (see FIG. 1).

When the spring means 1 is turned to store energy and then released, the spring means 1 will drive the driving gear 2 to rotate. Then, the driving gear 2 will drive the driven gear 3 to turn. At the time when the driven gear 3 is rotated, the eccentric shaft 31 thereon will turn about the axis of the driven gear 3. In the meantime, the linking rod 4 will swing backwards and forwards as the eccentric shaft 31 rotates with respect to the driven gear 3. Thus, the rocking horse connected with the driving rod 43 of the driven gear 3 will be oscillated.

The invention is naturally not limited in any sense the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An oscillating mechanism for a crystal ball comprising:

a crystall ball having a frame;

a spring means;

a driving gear connected with said spring means;

a driven gear engaged with said driving gear and having an eccentric shaft with a circular stop at the end; and a linking rod provided with two prongs fitted over the eccentric shaft of said driven gear, two arms pivotally mounted on the frame of the crystal ball, and a driving rod connected to a rocking horse disposed within said crystal ball.

* * * * *